US009459066B2

(12) United States Patent
Evans

(10) Patent No.: US 9,459,066 B2
(45) Date of Patent: Oct. 4, 2016

(54) COMPOUND BOWS WITH MODIFIED CAMS

(76) Inventor: John D. Evans, Calgary (CA)

( * ) Notice: Subject to any disclaimer, the term of this patent is extended or adjusted under 35 U.S.C. 154(b) by 1532 days.

(21) Appl. No.: 12/431,435

(22) Filed: Apr. 28, 2009

(65) Prior Publication Data

US 2010/0269808 A1 Oct. 28, 2010

(51) Int. Cl.
*F41B 5/10* (2006.01)
*F41B 5/14* (2006.01)

(52) U.S. Cl.
CPC ..... *F41B 5/105* (2013.01); *F41B 5/10* (2013.01); *F41B 5/14* (2013.01); *F41B 5/1403* (2013.01)

(58) Field of Classification Search
USPC ..... 124/25.6, 190
See application file for complete search history.

(56) References Cited

U.S. PATENT DOCUMENTS

| | | | | |
|---|---|---|---|---|
| 3,722,309 | A | 3/1973 | Shaffer | |
| 4,686,955 | A | 8/1987 | Larson | |
| 4,748,962 | A | 6/1988 | Larson | |
| 4,774,927 | A | 10/1988 | Larson | |
| 4,967,721 | A | 11/1990 | Larson | |
| 5,368,006 | A | 11/1994 | McPherson | |
| 5,495,843 | A | 3/1996 | Larson | |
| 5,623,915 | A | 4/1997 | Kudlacek | |
| 5,687,703 | A | 11/1997 | Vyprachticky | |
| 5,782,229 | A | 7/1998 | Evans et al. | |
| 5,791,322 | A | 8/1998 | McPherson | |
| 5,890,480 | A | 4/1999 | McPherson | |
| 6,112,732 | A | 9/2000 | Larson | |
| 6,474,324 | B1 | 11/2002 | Despart et al. | |
| 6,729,320 | B1 | 5/2004 | Terry | |
| 6,792,930 | B1 | 9/2004 | Kronengold et al. | |
| 6,966,312 | B1 | 11/2005 | Larson | |
| RE39,880 | E | 10/2007 | McPherson | |
| 7,305,979 | B1 | 12/2007 | Yehle | |
| 7,441,555 | B1 * | 10/2008 | Larson | 124/25.6 |
| 7,971,582 | B1 * | 7/2011 | Larson | 124/25.6 |

FOREIGN PATENT DOCUMENTS

| | | | |
|---|---|---|---|
| WO | 2009051520 | A2 | 4/2009 |

OTHER PUBLICATIONS

"Concept Archery", http://www.conceptarchery.com/, printed Feb. 12, 2009.

Office Action dated Sep. 18, 2013 and translation thereof issued in corresponding Chinese Patent application 201080028968.5.

European Search Report dated Jan. 2, 2014 issued in corresponding European Patent application 10769173.5.

* cited by examiner

*Primary Examiner* — Melba Bumgarner
*Assistant Examiner* — Amir Klayman
(74) *Attorney, Agent, or Firm* — Bull, Housser & Tupper LLP

(57) ABSTRACT

A compound bow comprising a handle portion having a first limb and a second limb extending outwardly therefrom, a wide body cam assembly pivotally coupled to the first limb near an outer end thereof, and a dual wheel assembly pivotally coupled to the second limb near an outer end thereof. The wide body cam assembly comprises a main sheave and a collector sheave located on opposite sides of a cable sheave. The main sheave is spaced apart from the cable sheave by a first distance sufficient to permit arrows to be fired from the bow free from interference by a cable without the use of a cable guard. The dual wheel assembly comprises a feed out sheave and a take in sheave separated by a second distance which is larger than the first distance. The feed out sheave is positioned substantially within a plane defined by the main sheave.

23 Claims, 12 Drawing Sheets

110

COMPOUND BOWS WITH MODIFIED CAMS

TECHNICAL FIELD

This invention relates generally to the field of compound archery bows. In particular, certain embodiments of the invention relate to single cam type compound archery bows.

BACKGROUND

Compound archery bows typically have a bowstring, on which an arrow may be nocked, along with one or more portions of cable other than the bowstring extending between the limbs of the bow. Such cable portions, sometimes referred to as "power cables", are generally located at least partly within or close to an operating plane of the bowstring. The power cables thus interfere with shooting arrows.

In order to provide adequate room for the arrow, it is conventional practice to mount a cable guard on the bow to engage the central portions of the power cables and to displace them laterally a sufficient distance to one side of the operating plane of the bowstring to avoid interference with an arrow. One drawback associated with conventional cable guards is that, in displacing the center of a power cable laterally from its straight line position, they introduce a lateral component to the force exerted by the power cable against the limbs. This lateral torque not only decreases the accuracy of arrow flight, but also causes twisting of the limbs, cams, wheels and/or handle, and thereby contributes adversely to shortening their useful life. Conventional cable guards also cause the power cables to feed on and off of the cams and wheels at an angle. This may sometimes lead to the power cables becoming dislodged from the cams and/or wheels.

There exist a number of prior art systems, other than cable guards, for preventing the power cables from interfering with the shooting of arrows from compound bows. Examples include U.S. Pat. No. 5,623,915 to Kulacek and No. 6,729,320 to Terry, and U.S. patent application Ser. No. 11/968,459 to Evans.

The inventor has determined a need for further systems which do not require cable guards to prevent power cables from interfering with the flight of arrows.

SUMMARY

One aspect of the invention provides a compound bow comprising a handle portion having a first limb and a second limb extending outwardly therefrom, a wide body cam assembly pivotally coupled to the first limb near an outer end thereof, and a dual wheel assembly pivotally coupled to the second limb near an outer end thereof. The wide body cam assembly comprises a main sheave and a collector sheave located on opposite sides of a cable sheave. The main sheave is spaced apart from the cable sheave by a first distance sufficient to permit arrows knocked on a bowstring portion extending between the main sheave and the feed out sheave to be fired from the bow free from interference by a cable extending within a plane defined by the cable sheave without the use of a cable guard. The dual wheel assembly comprises a feed out sheave and a take in sheave separated by a second distance which is larger than the first distance. The feed out sheave is positioned substantially within a plane defined by the main sheave.

Another aspect of the invention provides a wide body cam assembly for a compound bow. The wide body cam assembly comprises a main sheave and a collector sheave located on opposite sides of a cable sheave. The main sheave is spaced apart from the cable sheave by a distance of at least a radius of an arrow and its fletching.

Another aspect of the invention provides a dual wheel assembly for a compound bow. The dual wheel assembly comprises a feed out sheave and a take in sheave separated by a spacer. The spacer is configured such that the feed out sheave and the take in sheave are separated by a distance of at least twice a radius of an arrow and its fletching.

Another aspect of the invention provides a cam assembly for a compound bow. The cam assembly comprises a main sheave and a collector sheave located on opposite sides of a cable sheave. A pair of protrusions extend laterally outwardly from the main sheave and the collector sheave. The protrusions are adapted to be rotatably received in a pair of sockets defined in an end portion of a limb of the compound bow, such that no axle is required for coupling the cam assembly to the bow.

In addition to the exemplary aspects and embodiments described above, further aspects and embodiments will become apparent by reference to the drawings and by study of the following detailed descriptions.

BRIEF DESCRIPTION OF DRAWINGS

In drawings which illustrate non-limiting example embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
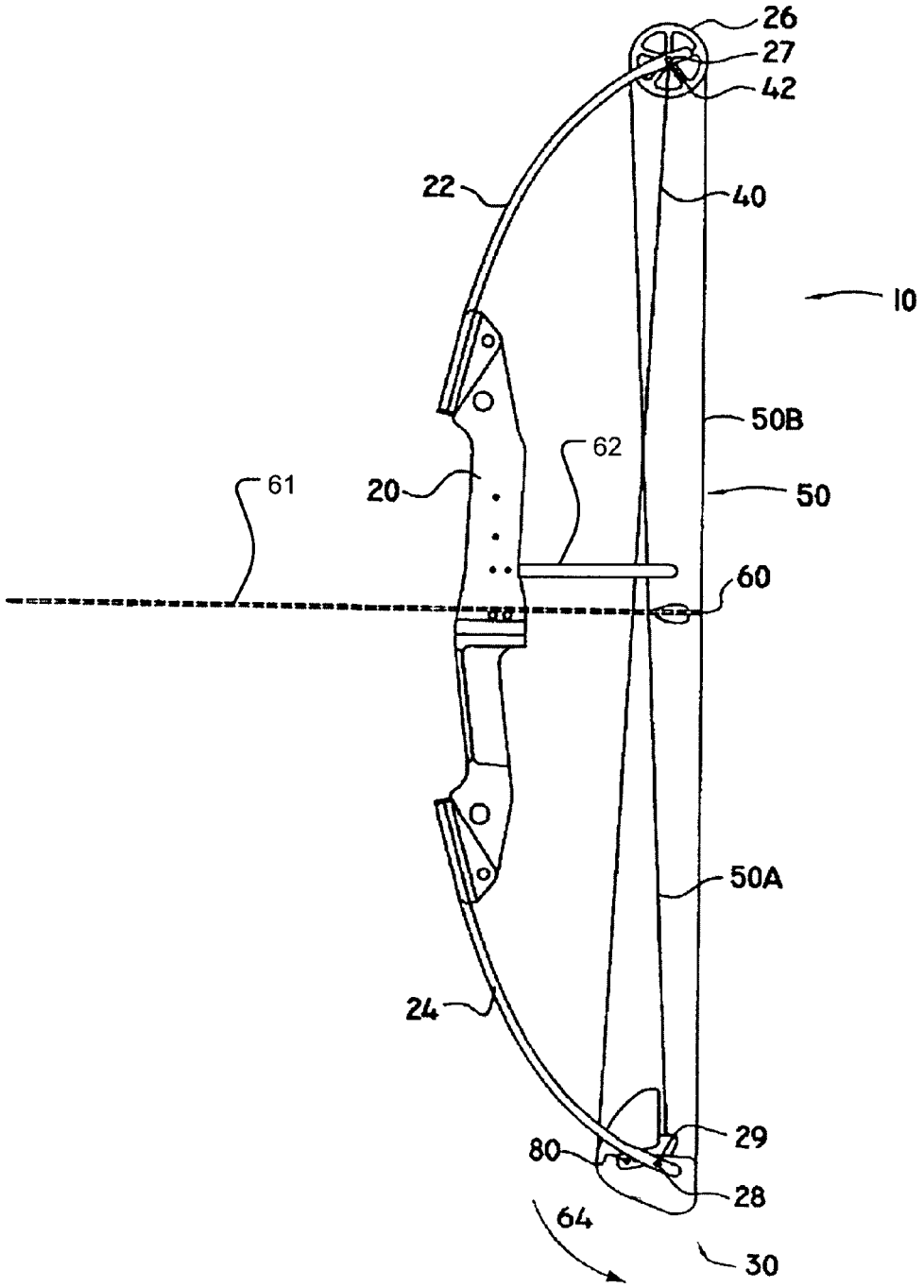
Figure 1 (Prior Art)
FIG. 1 shows an example of a prior art compound bow.

FIG. 1 depicts an example of a prior art single cam compound bow 10, such as disclosed in U.S. Pat. No. 5,782,229 to Evans et al., which is hereby incorporated herein by reference in its entirety. Bow 10 has a handle portion 20 to which are attached first and second resiliently deformable limbs 22, 24. Limb 22 is adapted to receive a pulley 26 at its outer end. Pulley 26 is free to rotate about an axis 27. Limb 24 is adapted to pivotally receive a cam assembly 30 at its outer end. Cam assembly 30 is mounted on an axle 28 and pivots about an axis 29. Limbs 22 and 24 may be adjustably and removably mounted to handle 20 so that the force required to draw bow 10 (the "draw weight") can be changed by adjusting the angles at which limbs 22 and 24 extend from handle portion 20 and/or by selecting limbs 22 and 24 which have a desired degree of rigidity.

Cam assembly 30 comprises three parallel sheaves (not shown in FIG. 1), which may be referred to as a main sheave, a collector sheave and a cable sheave. The cable sheave is typically located between the main sheave and the collector sheave. Each sheave may comprise a body having varying profiles, as described for example, in U.S. Pat. No. 5,782,229. A cable 40 extends from one or more attachment points 42 near the outer end of limb 22 or on pulley 26 to the front side of the cable sheave of cam assembly 30. A bowstring 50 has a first portion 50A extending from the back side of the collector sheave of cam assembly 30 to the front side of pulley 26. Bowstring 50 also has a second portion 50B which continues around pulley 26 and extends from the back side of pulley 26 to the back side of the main sheave of cam assembly 30. To shoot an arrow with bow 10, an arrow 61 (shown in dashed outline in FIG. 1) may be nocked on bowstring portion 50B at nock point 60, drawn back on bowstring portion 50B, and released. A cable guard 62 extends rearwardly from handle portion 20 to displace bowstring portion 50A and cable 40 and keep them from interfering with the shooting of arrow 61. When bowstring portion 50B is drawn rearwardly at nock point 60, cam assembly 30 rotates in the direction indicated by arrow 64. As cam assembly 30 rotates, cable 40 is wound onto the cable sheave thereby drawing the outer ends of limbs 22 and 24 together. At the same time, bowstring 50 is fed out by the collector sheave and the main sheave of cam assembly 30.

Figure 2:
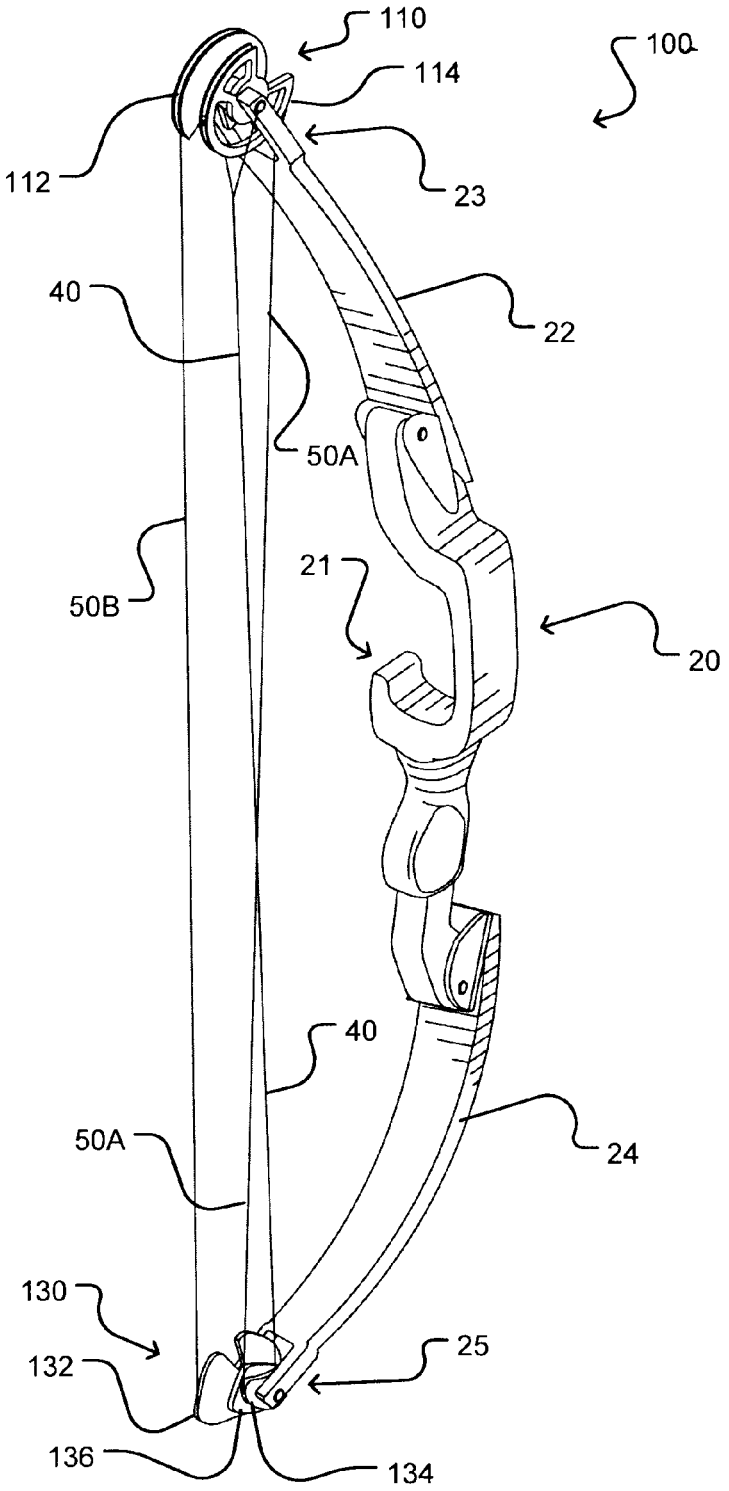
FIG. 2 shows a compound bow according to one embodiment of the invention.

FIG. 2 shows a single cam compound bow 100 according to one embodiment of the invention. Bow 100 is similar to bow 10 of FIG. 1, except that pulley 26 has been replaced with a dual wheel assembly 110 according to one embodiment of the invention, and cam assembly 30 has been replaced with a wide body cam assembly 130 according to another embodiment of the invention. Bow 100 may also differ from some prior art bows in that end portions 23 and 25 of limbs 22 and 24, respectively, may be somewhat larger on bow 100 than on some prior art bows to accommodate dual wheel assembly 110 and wide body cam assembly 130, respectively, as discussed below.

Other differences between bow 100 and various types of prior art bows may also exist. For example, an arrow rest portion 21 on handle portion 20 may be somewhat wider on bow 100 than on some prior art bows to accommodate the modified nocking position of bow 100, as discussed below.

Figure 3:
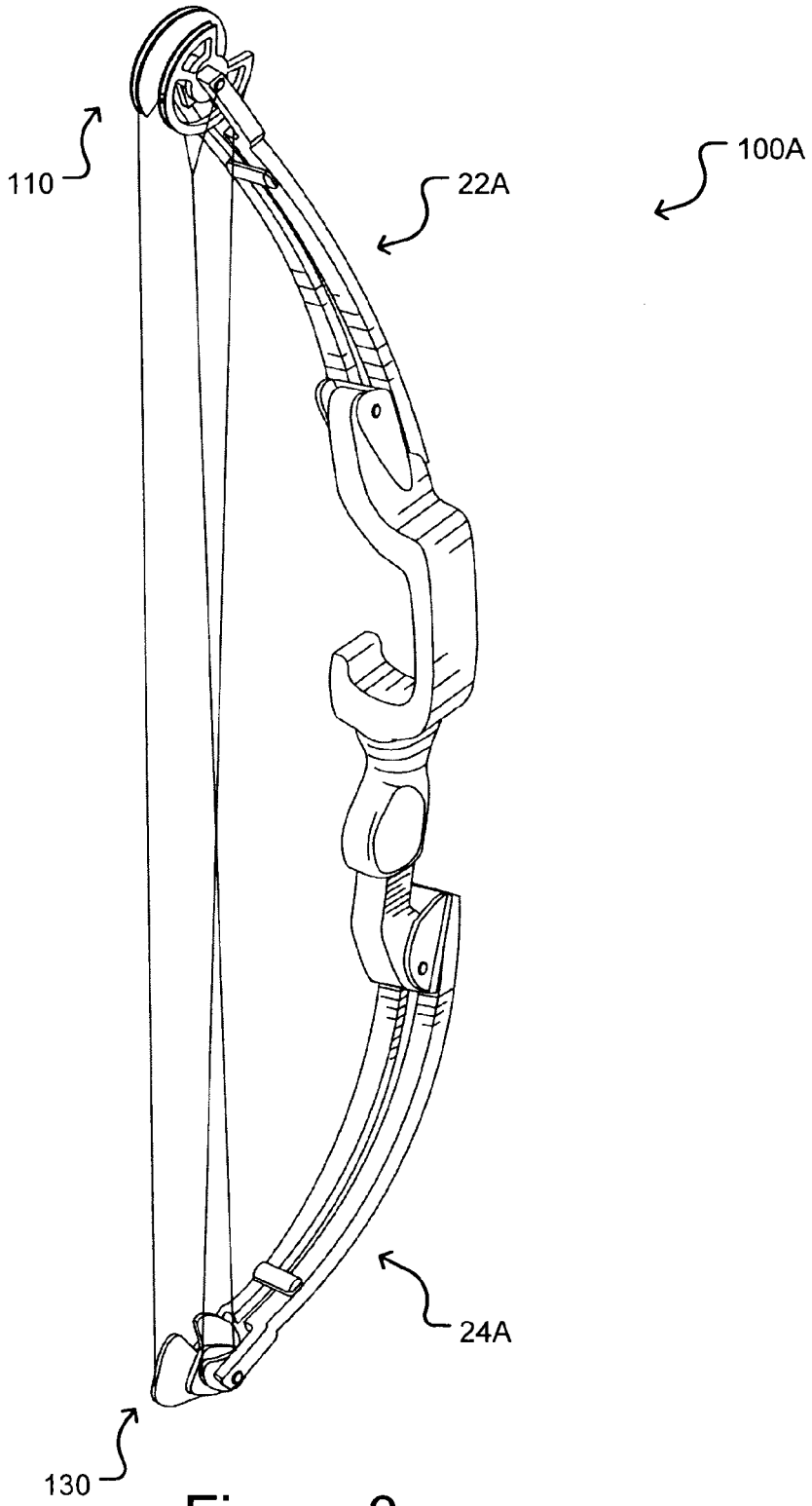
FIG. 3 shows a compound bow according to another embodiment of the invention.
Figure 4:
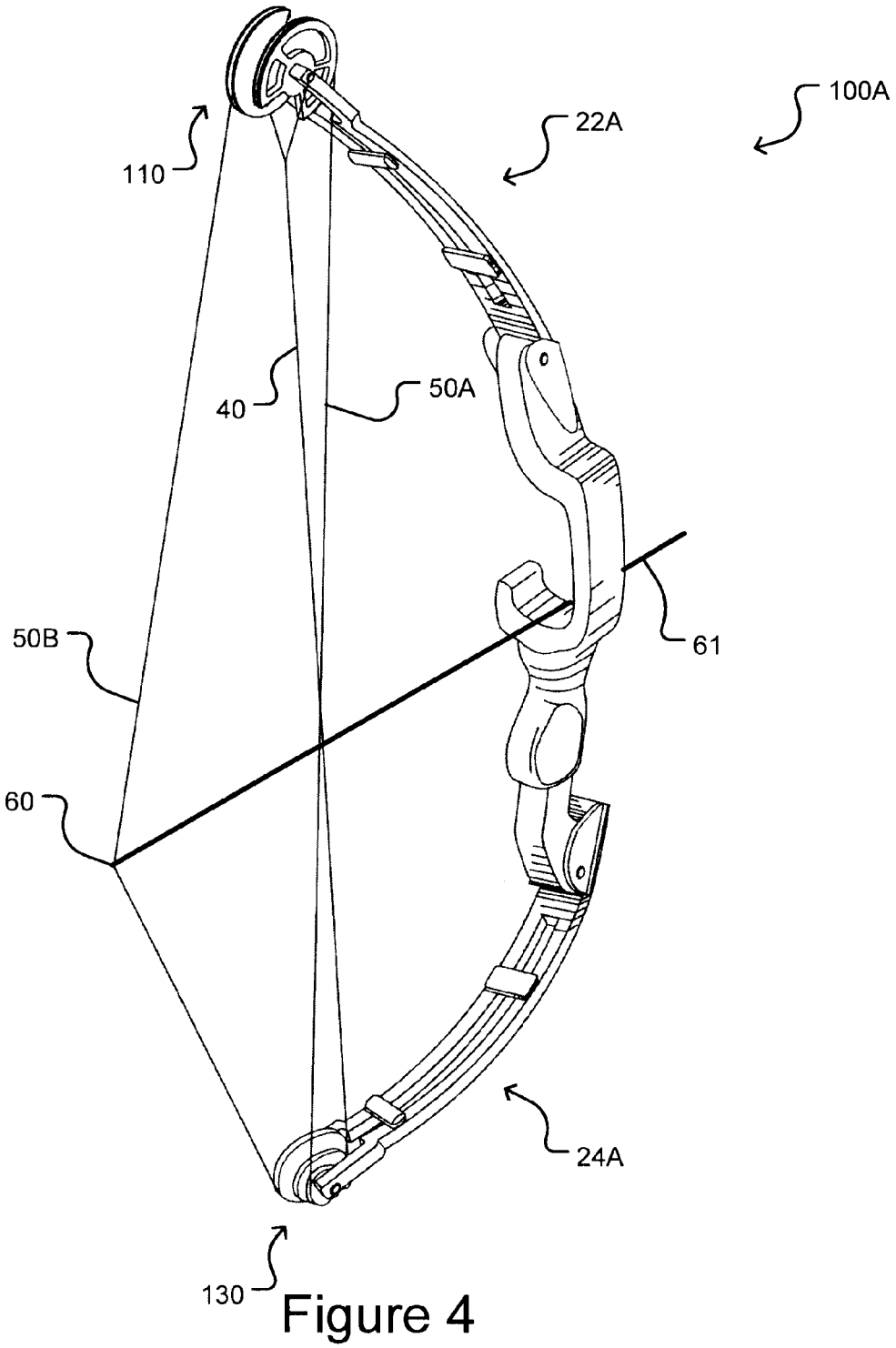
FIG. 4 shows the compound bow of FIG. 3 in a drawn position.

As one skilled in the art will appreciate, dual wheel assembly 110 and wide body cam assembly 130, or variations thereof, could be used with a variety of different types of compound bow. For example, FIG. 3 shows a compound bow 100A with split limbs 22A and 24A which includes dual wheel assembly 110 and wide body cam assembly 130. FIG. 4 shows bow 100A of FIG. 3 in a drawn position, wherein bowstring portion 50B has been pulled back at nock point 60, causing wheel assembly 110 to be rotated counterclockwise and cam assembly 130 to be rotated clockwise (from the perspective of a viewer of FIG. 4) from the orientations shown in FIG. 3. Other types of compound bows may also be equipped with wheel assemblies and/or cam assemblies according to various embodiments of the invention.

Figure 2A:
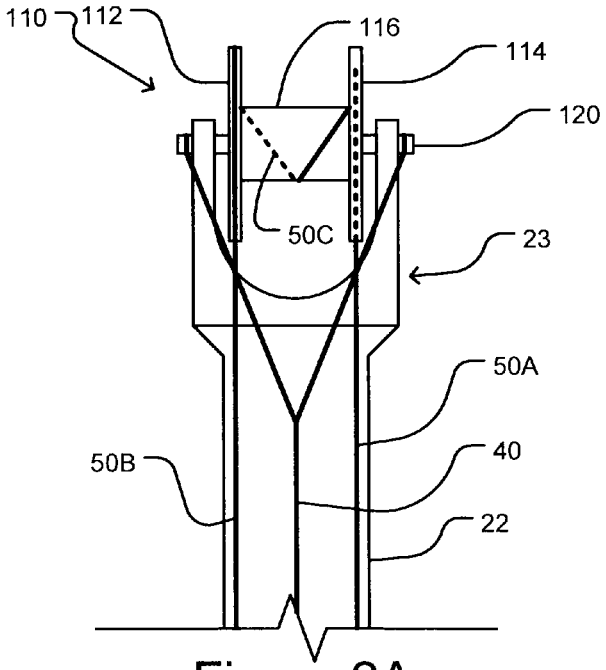
FIG. 2A is a rear schematic view of the wheel assembly of the bow of FIG. 2.
Figure 2C:
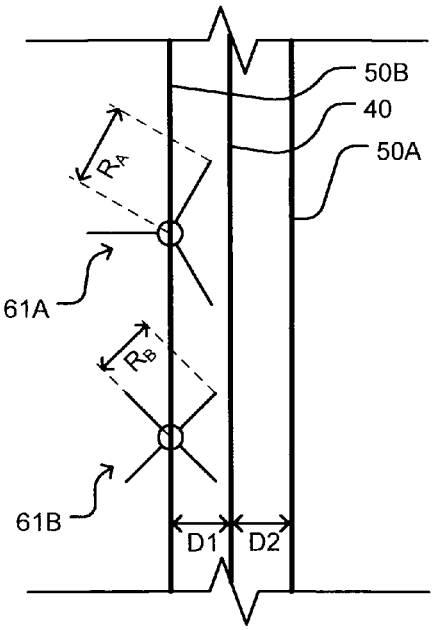
FIG. 2C is a rear schematic view of the bowstring and power cables of the bow of FIG. 2 illustrating how arrows may be knocked on the bowstring.
Figure 2B:
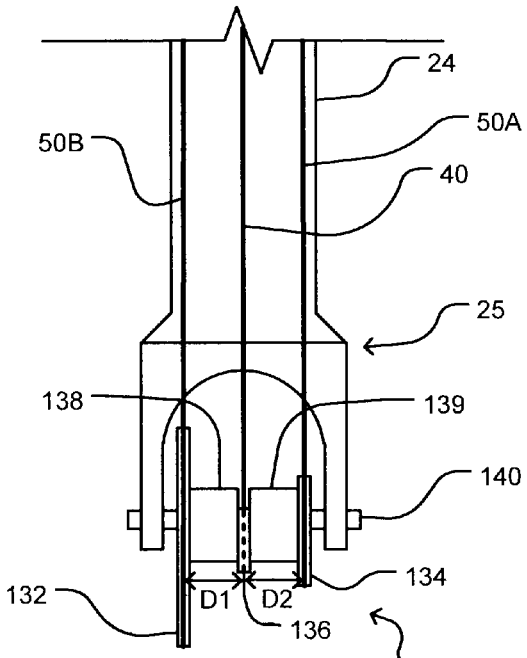
FIG. 2B is a rear schematic view of the cam assembly of the bow of FIG. 2.

FIGS. 2A and 2B schematically illustrate rear views of dual wheel assembly 110 and wide body cam assembly 130, respectively. The terms "rear", "back" and the like are used herein to refer to the direction opposite to that in which an arrow fired from bow 100 travels. Conversely, the terms "forward", "front" and the like are used to refer to the direction in which an arrow fired from bow 100 travels.

As shown in FIG. 2A, dual wheel assembly 110 comprises a feed out sheave 112 and a take in sheave 114 separated by a spacer 116. Each sheave 112, 114 of wheel assembly 110 comprises a body having a peripheral profile and a groove extending around the peripheral profile. Feed out sheave 112 and take in sheave 114 are preferably parallel to one another. Dual wheel assembly 110 may be mounted on an axle 120 extending through end portion 23 of limb 22 in some embodiments. In other embodiments, dual wheel assembly 110 may be mounted without an axle by providing protrusions 122 (not shown in FIG. 2A) on either side thereof which are received in bearings 124 (not shown in FIG. 2A) mounted in end portion 23 of limb 22, as described below with reference to FIGS. 7 and 8.

As shown in FIG. 2A, cable 40 may have a split portion at an end thereof, with the two sides of the split portion of cable 40 attached to the ends of axle 120 which may extend outwardly from end portion 23 of limb 22. In embodiments without an axle, the two sides of the split portion of cable 40 may be attached to other features (not shown) extending outwardly from end portion 23 of limb 22, or may be attached to housings (not shown) of bearings 124 extending slightly inwardly from end portion 23 of limb 22 on either side of dual wheel assembly 110. In embodiments where the two sides of the split portion of cable 40 are attached to the bearing housings, cable 40 may have a larger split portion to avoid the sides of the split portion of cable 40 from rubbing against sheaves 112 and 114 of dual wheel assembly 110.

Figure 7:
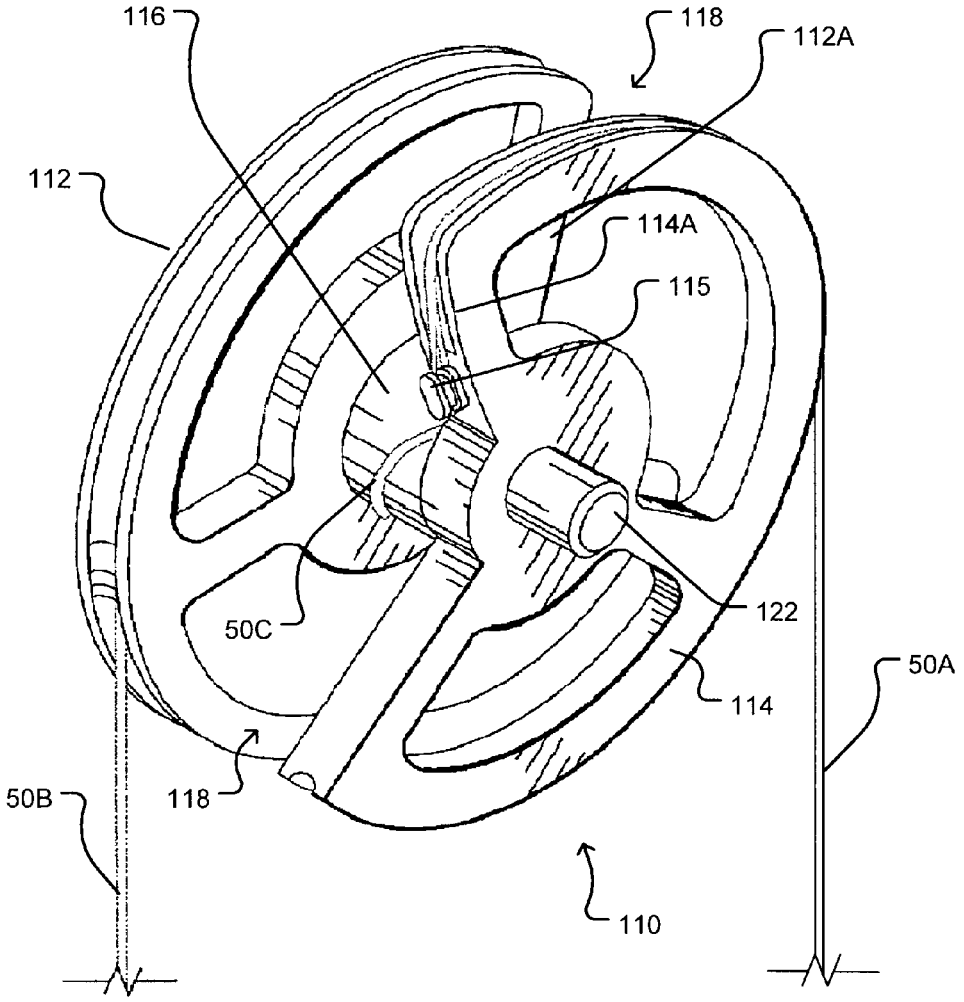
FIG. 7 shows a wheel assembly according to one embodiment of the invention.

Bowstring portion 50B may be wound around the back side of feed out sheave 112 and anchored thereto, and bowstring portion 50A may be wound around the front side of take in sheave 114 and anchored thereto. As shown in FIGS. 2A and 7, an intermediate portion 50C may connect bowstring portions 50A and 50B in embodiments where bowstring 50 is continuous. When bow 100 is in its undrawn position as shown in FIG. 2, bowstring portion 50A is only wound around a relatively small portion of the circumference of take in sheave 114 and bowstring portion 50B is wound around a substantial portion of feed out sheave 112. In some embodiments, bowstring portion 50A may, for example, be wound approximately 20 degrees around the circumference of take in sheave 114 when bow 100 is in its undrawn position. The angular extent to which bowstring portion 50A is wound around take in sheave 114 will typically depend on the draw length of bow 100 and the radius of take in sheave 114. In some embodiments, bowstring portion 50B may, for example, be wound approximately 280 degrees around feed out sheave 112 when bow 100 is in its undrawn position. The angular extent to which bowstring portion 50B is wound around feed out sheave 112 will typically depend on the draw length of bow 100 and the radius of feed out sheave 112.

As dual wheel assembly 110 rotates when bow 100 is being drawn, bowstring portion 50A winds onto take in sheave 114 and bowstring portion 50B winds off of feed out sheave 112, such that when bow 100 is in a drawn position (see FIG. 4), bowstring portion 50A is wound around a substantial portion of the circumference of take in sheave 114 and bowstring portion 50B is only wound around a relatively small portion of feed out sheave 112. Bowstring portion 50A may, for example, be wound approximately 280 degrees around the circumference of take in sheave 114 when bow 100 is in its fully drawn position. Bowstring portion 50B may, for example, be wound approximately 20 degrees around the circumference of feed out sheave 112 when bow 100 is in its fully drawn position. Bowstring portions 50A and 50B may be separate elements, or bowstring 50 may be continuous with portions 50A and 50B connected by an intermediate portion 50C extending across spacer 116, as described below with reference to FIGS. 7 to 9.

As shown in FIG. 2B, cam assembly 130 comprises a main sheave 132 and a collector sheave 134 located on opposite sides of a cable sheave 136. Main sheave 132, collector sheave 134 and cable sheave 136 are preferably parallel to one another. Each sheave 132, 134, 136 of cam assembly 130 comprises a body having a peripheral profile and a groove extending around the peripheral profile. Spacers 138 and 139 are provided to separate main sheave 132 and collector sheave 134 from cable sheave 136 by distances D1 and D2, respectively. Cam assembly 130 may be mounted with an axle 140 extending through end portion 25 of limb 24 in some embodiments. In other embodiments, cam assembly 130 may be mounted without an axle by providing protrusions 142 (not shown in FIG. 2B, see FIGS. 5 and 6A-6C) on either side thereof which are received in bearings 144 (not shown in FIG. 2B, see FIGS. 6A-6C) mounted in end portion 25 of limb 24, as described below.

Bowstring portions 50B and 50A may be wound around the back sides of main and collector sheaves 132 and 134, respectively, and anchored thereto. Cable 40 may be wound around the front side of cable sheave 136 and anchored thereto. When the bow is in its undrawn position (see FIGS. 2 and 3), cable 40 is only wound around a relatively small portion of the circumference of cable sheave 136, and bowstring portions 50B and 50A are wound around substantial portions of main and collector sheaves 132 and 134, respectively. When the bow is in a drawn position (see FIG. 4), cable 40 is wound around a substantial portion of the circumference of cable sheave 136, and bowstring portions 50B and 50A are only wound around relatively small portions of main and collector sheaves 132 and 134, respectively.

Figure 5:
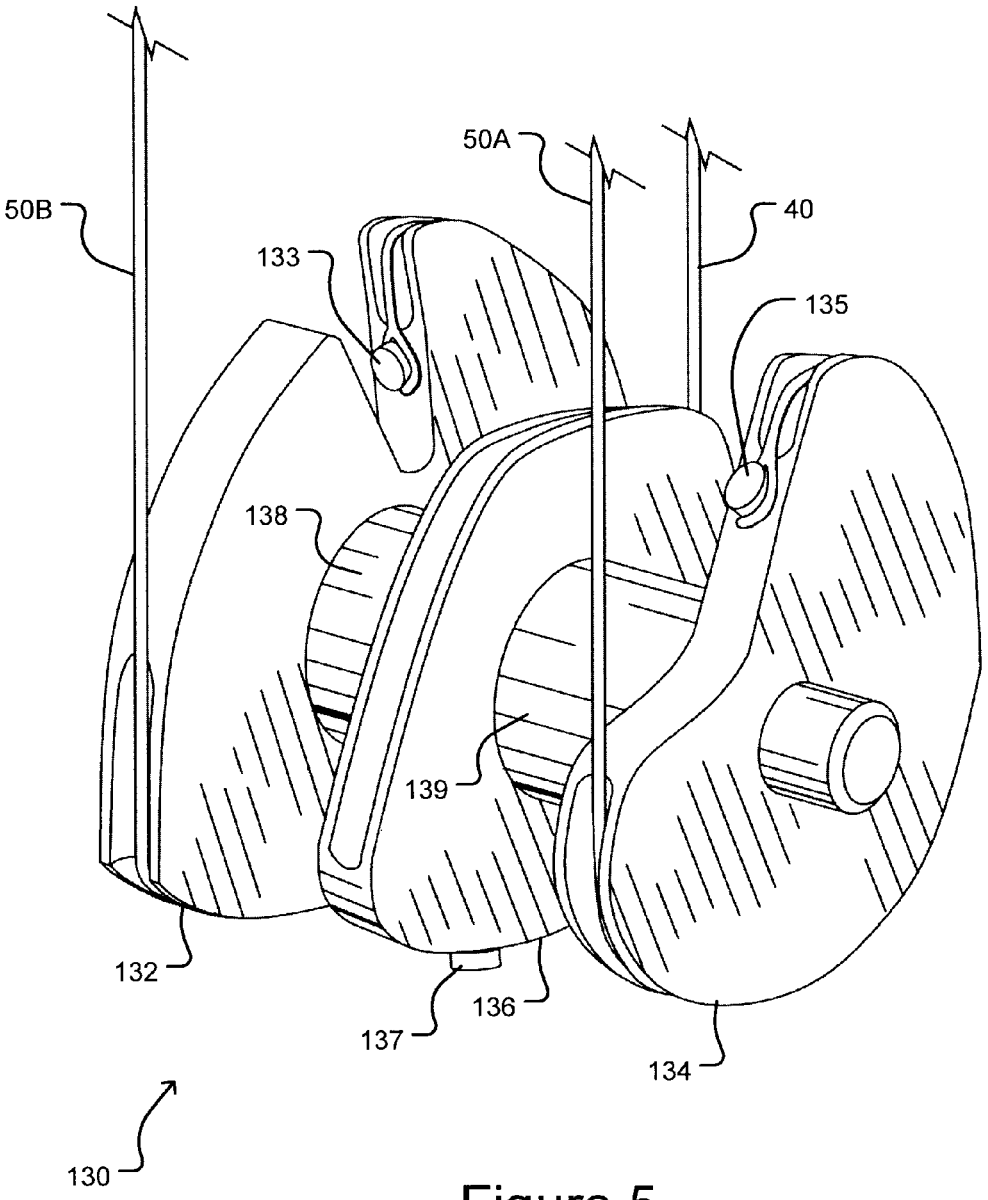
FIG. 5 shows a cam assembly according to one embodiment of the invention.

As shown in FIG. 5, cam assembly 130 may comprise a post 133 located at or near the end of the groove in main sheave 132 for anchoring bowstring portion 50B in some embodiments. Cam assembly 130 may also comprise a post 135 located at or near the end of the groove in collector sheave 134 for anchoring bowstring portion 50A and a post 137 located at or near the end of the groove in cable sheave 136 for anchoring cable 40. In some embodiments, multiple posts (not shown) may be provided near the end of the groove in main sheave 132 for providing a plurality of anchor points for bowstring portion 50B. Likewise, multiple posts (not shown) may be provided near the end of the groove in collector sheave 132 for providing a plurality of anchor points for bowstring portion 50A and multiple posts (not shown) may be provided near the end of the groove in cable sheave 136 for providing a plurality of anchor points for cable 40. In other embodiments, other structures may be provided for anchoring bowstring portions 50B and 50A and cable 40. In some embodiments, cam assembly 130 may comprise a cable anchor system such as disclosed, for example, in U.S. Pat. No. 4,967,721 to Larson, which is hereby incorporated by reference herein.

Wheel assembly 110 and cam assembly 130 may be configured such that feed out sheave 112 and main sheave 132 are substantially coplanar. Feed out sheave 112 and main sheave 132 define an operating plane for bowstring portion 50B. Cable sheave 136 of cam assembly 130 defines an operating plane for cable 40 which may be parallel to the operating plane for bowstring portion 50B and separated therefrom by distance D1. The spacing between main sheave 132 and cable sheave 136 ensures that cable 40 remains far enough away from the operating plane of bowstring portion 50B to avoid interfering with the shooting of arrows. The need for a cable guard is thus avoided.

Distance D1 is selected such that arrows nocked on bowstring portion 50B may be fired from bow 100 free from interference by cable 40, without requiring a cable guard. For example, as shown in FIG. 2C, for an arrow 61A having three-vaned fletching with a radius $R_A$, D1 may be at least $0.5 \times R_A$ in some embodiments. Similarly, in some embodiments, for an arrow 61B having four-vaned fletching with a radius $R_B$, D1 may be at least $0.707 \times R_B$. In some embodiments, D1 may be at least equal to a radius of an arrow and its fletching to be fired by bow 100, such that the arrow may be knocked on bowstring portion 50B with the vanes of its fletching oriented at any angle and fired without interference by cable 40. In some embodiments D1 may, for example, be at least ⅝" (1.6 cm).

The operating plane of bowstring portion 50B may thus be offset from the lateral center of bow 100. As noted above, bow 100 preferably comprises an arrow rest portion 21 which is large enough to extend through the operating plane of bowstring portion 50B to support an arrow nocked thereon.

Take in sheave 114 and collector sheave 134 may also be substantially coplanar. The operating plane of bowstring portion 50A may thus be separated from cable sheave 136 by distance D2.

In some embodiments, distance D2 is selected to be equal to distance D1, such that main sheave 132 and collector sheave 134 are equally separated from cable sheave 136 on either side thereof. Similarly, feed out sheave 112 and take in sheave 114 may be symmetrically positioned on wheel assembly 110. Such a configuration may balance the forces on wheel assembly 110 and cam assembly 130 and thus minimize twisting of limbs 22 and 24. For example, in embodiments where bowstring portions 50A and 50B are part of a continuous bowstring 50, bowstring 50 tends to "self center", such that the forces exerted by bowstring portions 50A and 50B tend to be substantially equal to each other.

In other embodiments, D1 and D2 may not be equal. Such embodiments may be suitable, for example, if the forces exerted by bowstring portions 50A and 50B are not equal, due to differences in the compositions and/or lengths of bowstring portions 50A and 50B or other factors. In such embodiments, D1 and D2 may be selected based on the ratio of the forces exerted by bowstring portions 50A and 50B to minimize twisting of limbs 22 and 24.

Wheel assembly 110 and cam assembly 130 may also be configured to ensure that nock 60 moves linearly, or at least substantially linearly, as bow 100 is fired (sometimes referred to as a "flat nock"). For example, a flat nock may be achieved by selecting appropriate peripheral profiles for the sheaves of the cam assembly, as described in U.S. Pat. No. 5,782,229.

Figure 6A:
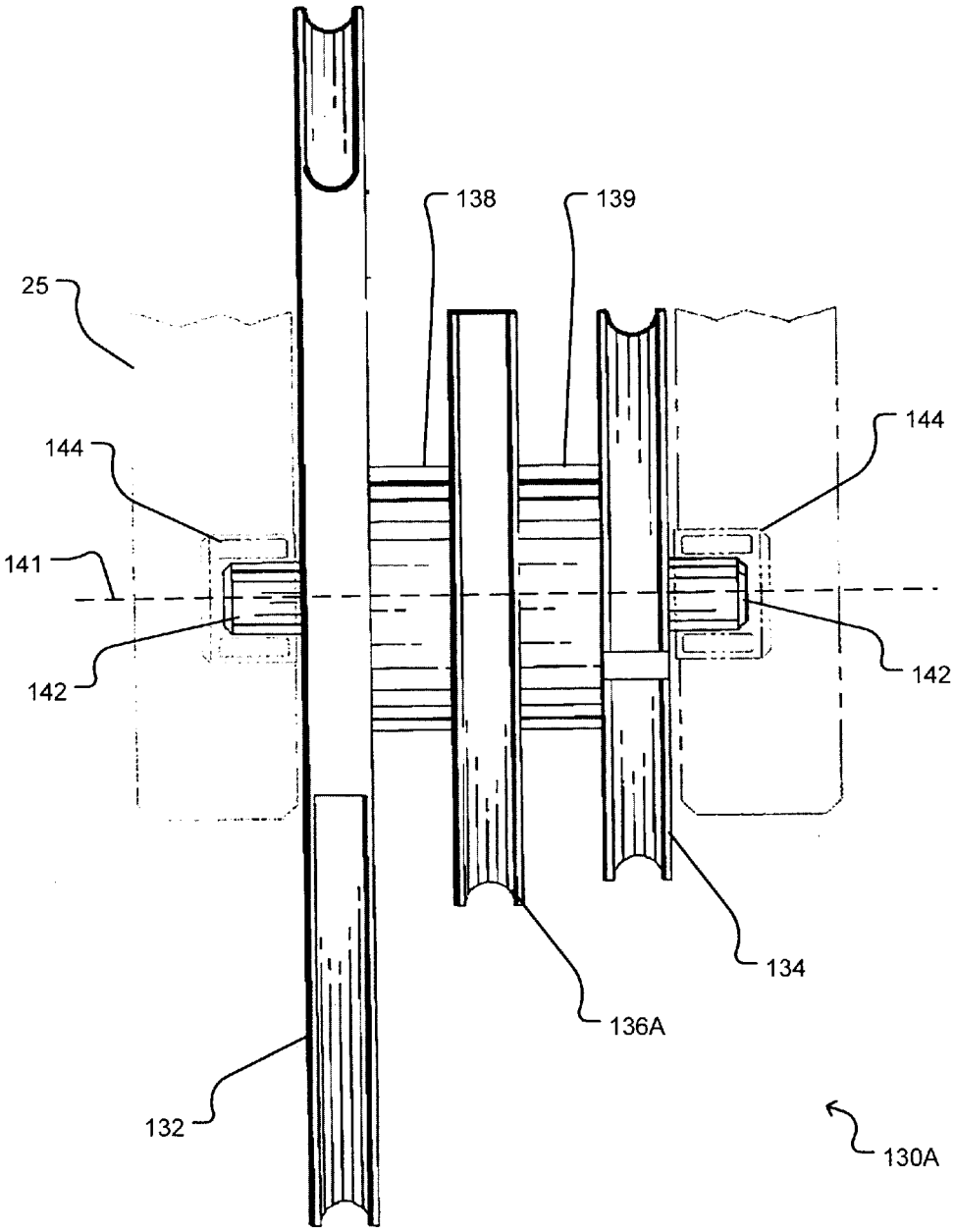
FIGS. 6A-6C are rear views of cam assemblies according to embodiments of the invention.
Figure 6B:
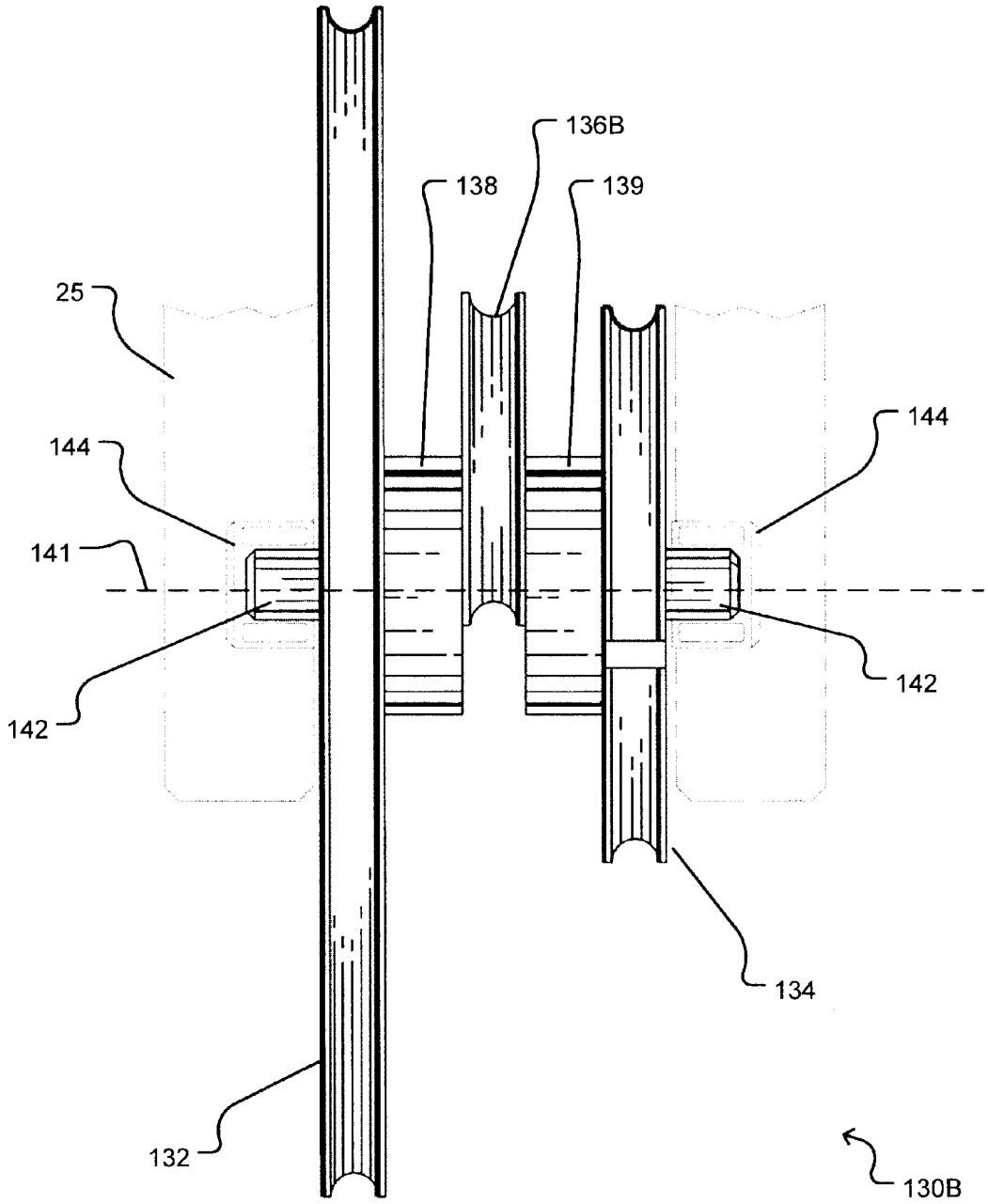
Figure 6C:
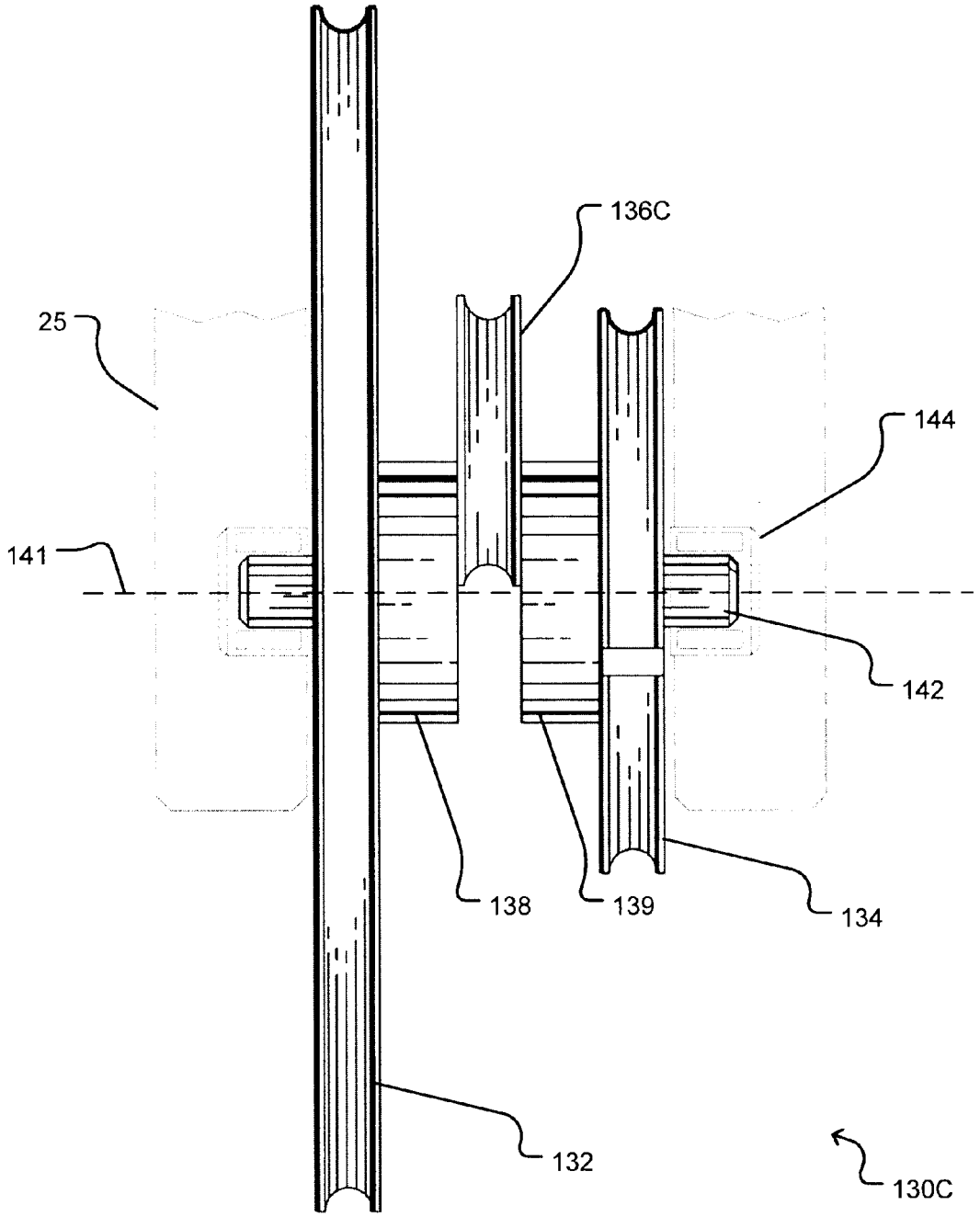

FIGS. 6A, 6B and 6C, show cam assemblies 130A, 130B and 130C, respectively, according to example embodiments of the invention. Each of cam assemblies 130A, 130B and 130C comprises a pair of protrusions 142 extending laterally outwardly therefrom. Protrusions 142 are received in bearings 144 mounted in sockets defined in end portion 25 of limb 24, such that each cam assembly 130A/130B/130C is rotatable about an axis 141. The need for an axle is thus eliminated. In other embodiments, bushings (not shown) may be provided in place of bearings 144.

Cam assemblies 130A, 130B and 130C (collectively cam assemblies 130) are all the same except for the configuration of cable sheaves 136A, 136B and 136C. As discussed in U.S. Pat. No. 5,782,229, the draw force curve of a compound bow may be altered by changing the configuration of the cable sheave. In some embodiments, removable modules (not shown) similar to those described in the above noted U.S. Pat. No. 5,782,229 may be provided for altering the profile of cable sheave 136 and producing varying draw force curves. In some embodiments, cable sheave 136, or a portion thereof, may be rotatable with respect to cam assembly 130 in a manner similar to that described in U.S. Pat. Nos. 4,686,955 and 4,774,927 to Larson, which are hereby incorporated by reference herein, in order to produce varying draw force curves.

The range of variation of the cable sheave disclosed in U.S. Pat. No. 5,782,229 and other prior art compound bows is limited by the presence of an axle through the cam assembly. By providing protrusions 142 instead of an axle, cam assemblies according to certain embodiments of the invention may be provided with a wider range of cable sheave profiles. For example, cable sheaves of cam assemblies of some embodiments may be configured to be very close to or along axis 141 at some points around the peripheral profile thereof (as illustrated by cable sheave 136B of FIG. 6B), or even configured to be "inside" of axis 141 at some points (as illustrated by cable sheave 136C of FIG. 6C). Cam assemblies 130 may thus provide compound bows with draw force curves having let off values ranging anywhere up to and including 100 percent. However, as one skilled in the art will appreciate, 100 percent let off may not be desirable in many embodiments, but certain embodiments of the invention permit the design of a compound bow having a let off as close to 100 percent as desired. For example, compound bows according to some embodiments may have a let off of at least 99 percent.

Figure 8:
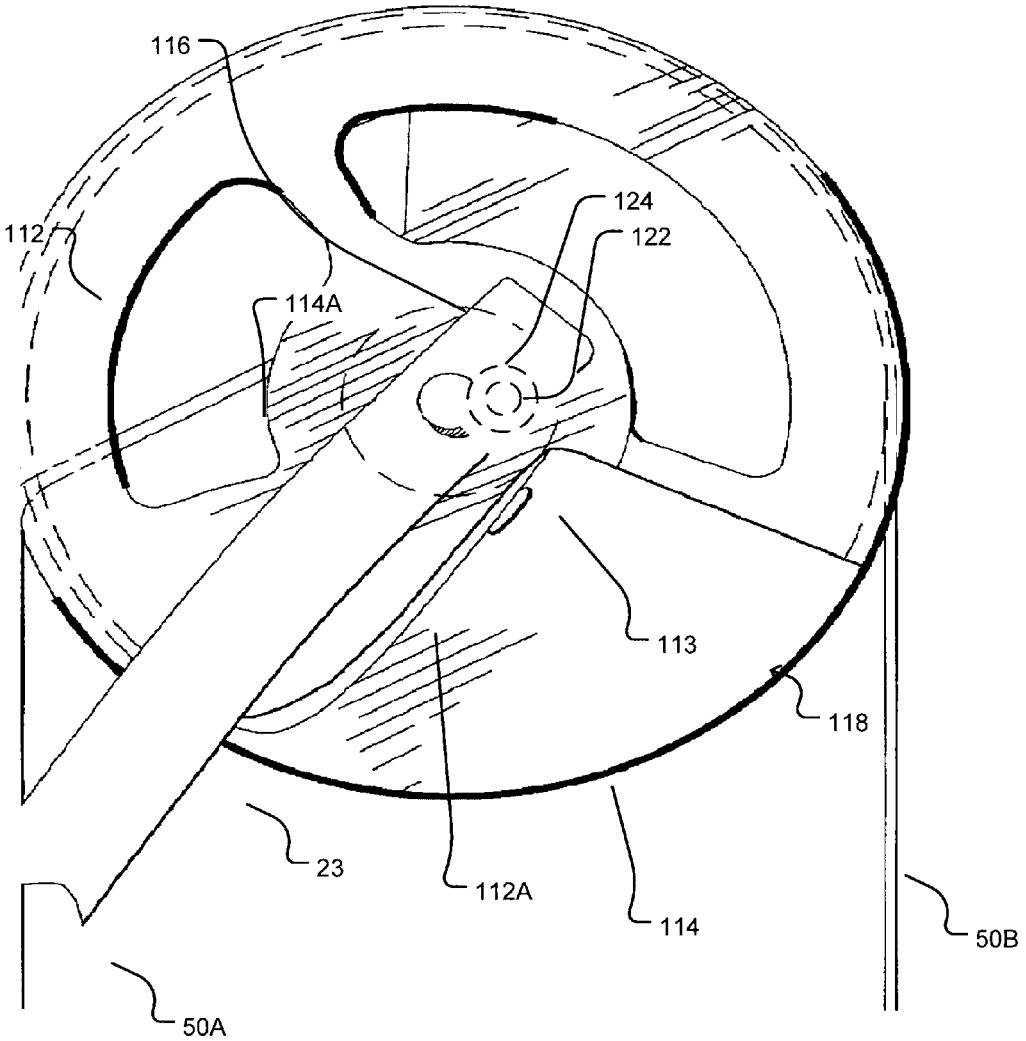
FIG. 8 is a side view of the wheel assembly of FIG. 7 attached to a bow limb; and, FIG. 9 shows a wheel assembly according to another embodiment of the invention.

Dual wheel assembly 110 may also be rotatably mounted to limb 22 without the use of an axle. As shown in FIGS. 7 and 8, wheel assembly 110 may comprise a pair of protrusions 122 extending laterally outwardly therefrom. Protrusions 122 are received in bearings 124 mounted in sockets defined in end portion 23 of limb 22, such that wheel assembly is rotatable about an axis. The need for an axle is thus eliminated.

With reference to FIGS. 7 and 8, each sheave 112, 114 of dual wheel assembly 110 comprises a body having a peripheral profile and a groove extending around the peripheral profile. In the illustrated embodiment, the peripheral profile of each of feed out sheave 112 and take in sheave 114 is partially circular, each having a cut out portion 118 such that the peripheral profile defines a circular arc. In other embodiments, either or both of feed out sheave 112 and take in sheave 114 may have non-circular peripheral profiles. For example, in some embodiments the peripheral profile of either or both of feed out sheave 112 and take in sheave 114 may comprise a cut out portion defining an elliptical arc.

In some embodiments, cut out portions 118 of sheaves 112, 114 are angularly offset from each other such that the radius of the peripheral profile of each sheave 112, 114 remains relatively constant at the point at which each bowstring portion 50B, 50A contacts the respective sheave 112, 114 throughout the range of motion of dual wheel assembly 110. For example, in some embodiments, cut out portions 118 may be angularly offset from each other by an angle ranging from 60 to 180 degrees. The angular extent of the arc portion of the peripheral profile of each sheave 112, 114 may, for example, range from about 220 to 300 degrees in some embodiments. In some embodiments, the angular extent of the arc portion of the peripheral profile of each sheave 112, 114 may, for example, be selected based on the size and shape of main sheave 132.

In the illustrated example, each sheave 112, 114 has an inwardly angled portion 112A, 114A, respectively, extending into cut out portion 118. An anchor post 113, 115 is located at or near the end of each respective inwardly angled portion 112A, 114A, for anchoring the respective bowstring portion 50B, 50A. As noted above, bowstring 50 may be continuous or may comprise separate parts. In embodiments where bowstring 50 is continuous, bowstring 50 may comprise an intermediate portion 50C extending between take in sheave 114 and feed out sheave 112 around or across spacer 116. In such embodiments, bowstring 50 may wrap around each of posts 113 and 115 to prevent bowstring 50 from slipping relative to wheel assembly 110, such that intermediate portion 50C does not move with respect to wheel assembly 110 as the bow is fired. Also, spacer 116 may optionally define a groove (not shown) therein for receiving intermediate portion 50C of bowstring 50. In embodiments where bowstring 50 is continuous, bowstring portion 50A may be anchored to collector sheave 134, extend upward to and partially around take in sheave 114, wrap around post 115, continue across and around spacer 116 as intermediate portion 50C, wrap around post 113, continue around feed out sheave 112 as bowstring portion 50B, and extend down to be anchored to main sheave 132. In embodiments where bowstring 50 is in two parts, intermediate portion 50C may be omitted, and bowstring portion 50A may terminate at post 115 and bowstring portion 50B may terminate at post 113, for example.

Figure 9:
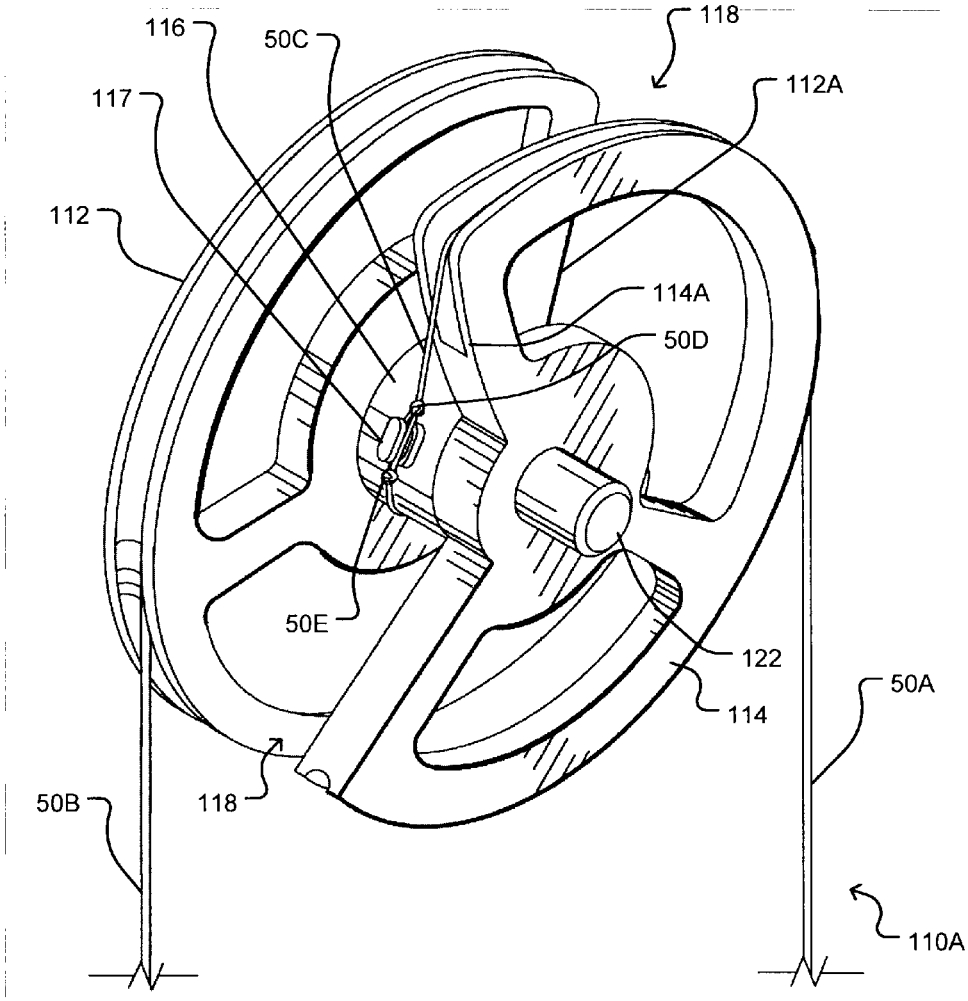

FIG. 9 shows a dual wheel assembly 110A according to another embodiment of the invention. Dual wheel assembly 110A is the same as dual wheel assembly 110 of FIGS. 7 and 8 except that dual wheel assembly 110A has a single anchor post 117 extending outwardly from a central portion of spacer 116 instead of posts 113 and 115. Intermediate portion 50C of bowstring 50 may have two knots 50D and 50E tied therein, and the individual strands which make up bowstring 50 may be separated into two groups between knots 50D and 50E, and the groups of strands may be placed on either side of post 117.

Dual wheel assembly 110 and wide body cam assembly 130 may be constructed using a variety of techniques. In some embodiments dual wheel assembly 110 and wide body cam assembly 130 may each be machined from a block of metal such as, for example, aluminum. In other embodiments, dual wheel assembly 110 and wide body cam assembly 130 may be formed by injection molding using a high strength plastic or other polymeric material. In still other embodiments, the some or all of the various sheaves and spacers of dual wheel assembly 110 and wide body cam assembly 130 may be individually formed (either through machining or injection molding), and the individually formed parts may then be bolted or otherwise securely fastened together.

While a number of exemplary aspects and embodiments have been discussed above, those of skill in the art will recognize certain modifications, permutations, additions and sub-combinations thereof. For example:

In the illustrated embodiments, the dual wheel assembly is mounted on the "upper" limb of the bow (with respect to the orientation of the bow's handle) and the wide body cam assembly is mounted on the lower limb of the bow. The locations of the dual wheel assembly and the wide body cam assembly could be exchanged in other embodiments.

The bodies of the sheaves of the wheel assembly and/or the cam assembly may have a number of openings therethrough, as shown in the illustrated embodiments, to reduce the weights thereof. The bodies of the sheaves could be generally solid in other embodiments.

It is therefore intended that the following appended claims and claims hereafter introduced are interpreted to include all such modifications, permutations, additions and sub-combinations as are within their true spirit and scope.

What is claimed is:

1. A single cam compound bow comprising:

a handle portion having a first limb and a second limb extending outwardly therefrom;

a wide body cam assembly pivotally coupled to the first limb near an outer end thereof, the wide body cam assembly comprising a main sheave and a collector sheave located on opposite sides of a cable sheave, the main sheave spaced apart from the cable sheave by a first distance;

a dual wheel assembly pivotally coupled to the second limb near an outer end thereof, the dual wheel assembly comprising a feed out sheave and a take in sheave held in fixed relation to one another to rotate in unison and separated by a second distance which is larger than the first distance, the feed out sheave positioned substantially within a plane defined by the main sheave;

a first bowstring portion having a nock point thereon for nocking an arrow, the first bowstring portion extending from the main sheave of the wide body cam assembly to the feed out sheave of the dual wheel assembly and a second bowstring portion extending from the collector sheave of the wide body cam assembly to the take in sheave of the dual wheel assembly; and, a cable having a first end coupled to the cable sheave of the wide body cam assembly and a second end comprising a split portion coupled to a pair of attachment points on or near the outer end of the second limb on either side of the dual wheel assembly wherein the first distance is sufficient to permit arrows knocked on the first bowstring portion extending between the main sheave and the feed out sheave to be fired from the bow free from interference by a cable extending within a plane defined by the cable sheave without the use of a cable guard.

2. A single cam compound bow according to claim 1 wherein the take in sheave is positioned substantially within a plane defined by the collector sheave.

3. A single cam compound bow according to claim 2 wherein the collector sheave is spaced apart from the cable sheave by the first distance.

4. A single cam compound bow according to claim 1 wherein the first distance is at least 0.5 times a radius of a three-vaned arrow and its fletching.

5. A single cam compound bow according to claim 1 wherein the first distance is at least 0.707 times a radius of a four-vaned arrow and its fletching.

6. A single cam compound bow according to claim 1 wherein the first distance is at least a radius of an arrow and its fletching.

7. A single cam compound bow according to claim 1 wherein the first distance is at least ⅝".

8. A single cam compound bow according to claim 1 wherein the feed out sheave and the take in sheave are substantially parallel to one another, and the main sheave, the collector sheave and the cable sheave are substantially parallel to one another.

9. A single cam compound bow according to claim 1 wherein the outer end of the first limb comprises a pair of sockets defined therein, and wherein the wide body cam assembly comprises a pair of protrusions extending laterally outwardly therefrom, the protrusions adapted to be rotatably received in the pair of sockets defined in the outer end of the first limb.

10. A single cam compound bow according to claim 9 wherein the sockets comprise bearings or bushings.

11. A single cam compound bow according to claim 10 wherein an axis of rotation of the wide body cam assembly lies along or outside of a peripheral profile of the cable sheave.

12. A single cam compound bow according to claim 1 wherein the outer end of the second limb comprises a pair of sockets defined therein, and wherein the dual wheel assembly comprises a pair of protrusions extending laterally outwardly therefrom, the protrusions adapted to be rotatably received in the pair of sockets defined in the outer end of the second limb, the sockets comprising bearings or bushings.

13. A single cam compound bow according to claim 1 wherein the wide body cam assembly comprises a first spacer between the main sheave and the cable sheave and a second spacer between the collector sheave and the cable sheave.

14. A single cam compound bow according to claim 13 wherein the dual wheel assembly comprises a third spacer between the feed out sheave and the take in sheave.

15. A single cam compound bow according to claim 1 wherein the first and second bowstring portions comprise portions of a single continuous bowstring, the first and second bowstring portions connected by an intermediate bowstring portion extending between the take in sheave and the feed out sheave of the dual wheel assembly.

16. A single cam compound bow according to claim 1 wherein the first and second bowstring portions comprise separate elements.

17. A single cam compound bow according to claim 16 wherein the collector sheave is spaced apart from the cable sheave by a third distance having a ratio with the first distance based at least in part on a ratio of forces exerted by the first and second bowstring portions so as to minimize twisting of the limbs.

18. A single cam compound bow according to claim 1 wherein the main sheave, the collector sheave and the cable sheave of the wide body cam assembly have peripheral profiles configured such that the nock point moves substantially linearly as the bow is fired.

19. A single cam compound bow according to claim 1 wherein the feed out sheave and the take in sheave of the dual wheel assembly each comprise a peripheral profile having a cut out portion and an arc portion.

20. A single cam compound bow according to claim 19 wherein the cut out portions of the peripheral profiles of the feed out sheave and the take in sheave are angularly offset from each other.

21. A single cam compound bow according to claim 20 wherein the arc portions of the peripheral profiles of the feed out sheave and the take in sheave range in angular extent from 220 to 300 degrees.

22. A single cam compound bow according to claim 21 comprising an anchor post located along an inwardly angled side of each of the cut out portions of the peripheral profiles of the feed out sheave and the take in sheave.

23. A single cam compound bow according to claim 21 comprising a spacer between the feed out sheave and the take in sheave and an anchor post located on the spacer.

* * * * *